US009333747B2

(12) United States Patent
Takagiwa

(10) Patent No.: US 9,333,747 B2
(45) Date of Patent: May 10, 2016

(54) PRINT DEVICE

(71) Applicant: BROTHER KOGYO KABUSHIKI KAISHA, Nagoya-shi, Aichi-ken (JP)

(72) Inventor: Yutaka Takagiwa, Kariya (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 0 days.

(21) Appl. No.: 14/858,543

(22) Filed: Sep. 18, 2015

(65) Prior Publication Data

US 2016/0082730 A1 Mar. 24, 2016

(30) Foreign Application Priority Data

Sep. 24, 2014 (JP) ..... 2014-194244

(51) Int. Cl.
*B41J 2/14* (2006.01)
*B41J 2/175* (2006.01)

(52) U.S. Cl.
CPC ..... *B41J 2/1433* (2013.01)

(58) Field of Classification Search
CPC .. B41J 2/1752; B41J 2/17513; B41J 2/17523; B41J 2/17526; B41J 2/17533; B41J 2/17546; B41J 2002/17516; B41J 2/17586; B41J 2/18
USPC ..... 347/7, 49, 84, 85, 86, 87, 89
See application file for complete search history.

(56) References Cited

U.S. PATENT DOCUMENTS 6,290,343 B1 * 9/2001 Lewis ..... B41J 2/175 347/85
6,471,333 B1 * 10/2002 Powell ..... B41J 2/175 347/49
8,353,581 B2 * 1/2013 Shimizu ..... B41J 2/1752 251/318
8,864,291 B2 * 10/2014 Urabe ..... B41J 2/1752 347/86
9,033,475 B2 * 5/2015 Urabe ..... B41J 2/17556 347/5
2012/0105556 A1 5/2012 Urabe
2015/0022598 A1 1/2015 Urabe

FOREIGN PATENT DOCUMENTS

JP H11-115203 A 4/1999
JP 2012-096422 A 5/2012

* cited by examiner

*Primary Examiner* — Anh T.N. Vo
(74) *Attorney, Agent, or Firm* — Fox Rothschild LLP

(57) ABSTRACT

The present disclosure relates to a print device that can reduce the number of parts and also reduce the possibility of printing quality deterioration. The print device includes a first mount portion, a second mount portion and a head. The first mount portion is located in a first region, and the second mount portion is located in a second region. The second region is a region in which a distance from the nozzle face in the up-down direction is out of a predetermined range, and the first region is a region in which a distance from the nozzle face in the up-down direction is in the predetermined range. The first mount portion is connected to a reservoir passage. The reservoir passage has a sub-tank. The sub-tank is located in the second region. The second mount portion is connected to a non-reservoir passage that has no sub-tank.

11 Claims, 11 Drawing Sheets

PRINT DEVICE

CROSS-REFERENCE TO RELATED APPLICATION

This application claims priority to Japanese Patent Application No. 2014-194244 filed on Sep. 24, 2014, the disclosure of which is herein incorporated by reference in its entirety.

BACKGROUND

The present disclosure relates to a print device.

BACKGROUND

There is known a print device that includes a plurality of mount portions for mounting ink cartridges. The print device has a head for injecting an ink onto a printing medium. The head includes a nozzle face that has a nozzle configured to inject the ink. The mount portions are located in the horizontal direction or the vertical direction. A sub-tank that can reserve the ink may be provided on an ink passage extending toward the head from the mount portions.

SUMMARY

The nozzle face holds the ink with the meniscus created by the surface tension of the ink. If there is no sub-tank on a fluid passage between the mount portion and the nozzle surface and the mount portions are arranged in the horizontal direction, the head difference between the nozzle face and one mount portion becomes equal to the head difference between the nozzle face and any one of the remaining mount portions, and the ink holding by means of the meniscus becomes appropriate. However, the length of the print device becomes long in the horizontal direction. When the mount portions are arranged in the vertical direction, the length of the print device becomes short in the horizontal direction, but the head differences between the nozzle face and the respective mount portions are different from one mount portion to another mount portion. If the head difference between a cartridge mounted in the mount portion and the nozzle face falls outside a prescribed range, the meniscus on the nozzle face is destroyed. This may cause defective ink injection, and reduce the printing quality.

When the mount portions are arranged in the vertical direction and the sub-tanks are arranged in the horizontal direction, the head differences between the nozzle face and the respective sub-tanks are equal to each other. Consequently, it is possible to reduce the possibility of defective injection. However, if all the fluid passages (channels) are provided with the sub-tanks, then a problem arises, i.e., the number of parts increases.

Various embodiments of the general principles described herein provide a print device that can reduce the number of parts and also reduce the possibility of printing quality deterioration.

A print device of an embodiment includes a head having a nozzle face, and the nozzle face has a nozzle for injecting liquid. The print device also includes a plurality of mount portions arranged in an up-down direction. Each of the mount portions is configured to mount each of a plurality of containers, and each of the plurality of the containers is configured to contain the liquid. The plurality of the mount portions include a first mount portion located in a first region. The first region is a region in which a distance from the nozzle face in the up-down direction is out of a predetermined range. The plurality of the mount portions also include a second mount portion located in a second region. The second region is a region in which a distance from the nozzle face in the up-down direction is in the predetermined range. The print device also includes a reservoir passage configured to connect the first mount portion to the head. The reservoir passage has a reservoir located in the second region. The reservoir is configured to reserve the liquid. The print device also includes a non-reservoir passage configured to connect the second mount portion to the head. The non-reservoir passage has no reservoir.

BRIEF DESCRIPTION OF THE DRAWINGS

Embodiments will be described below in detail with reference to the accompanying drawings in which.

DESCRIPTION OF EMBODIMENTS

Figure 1:
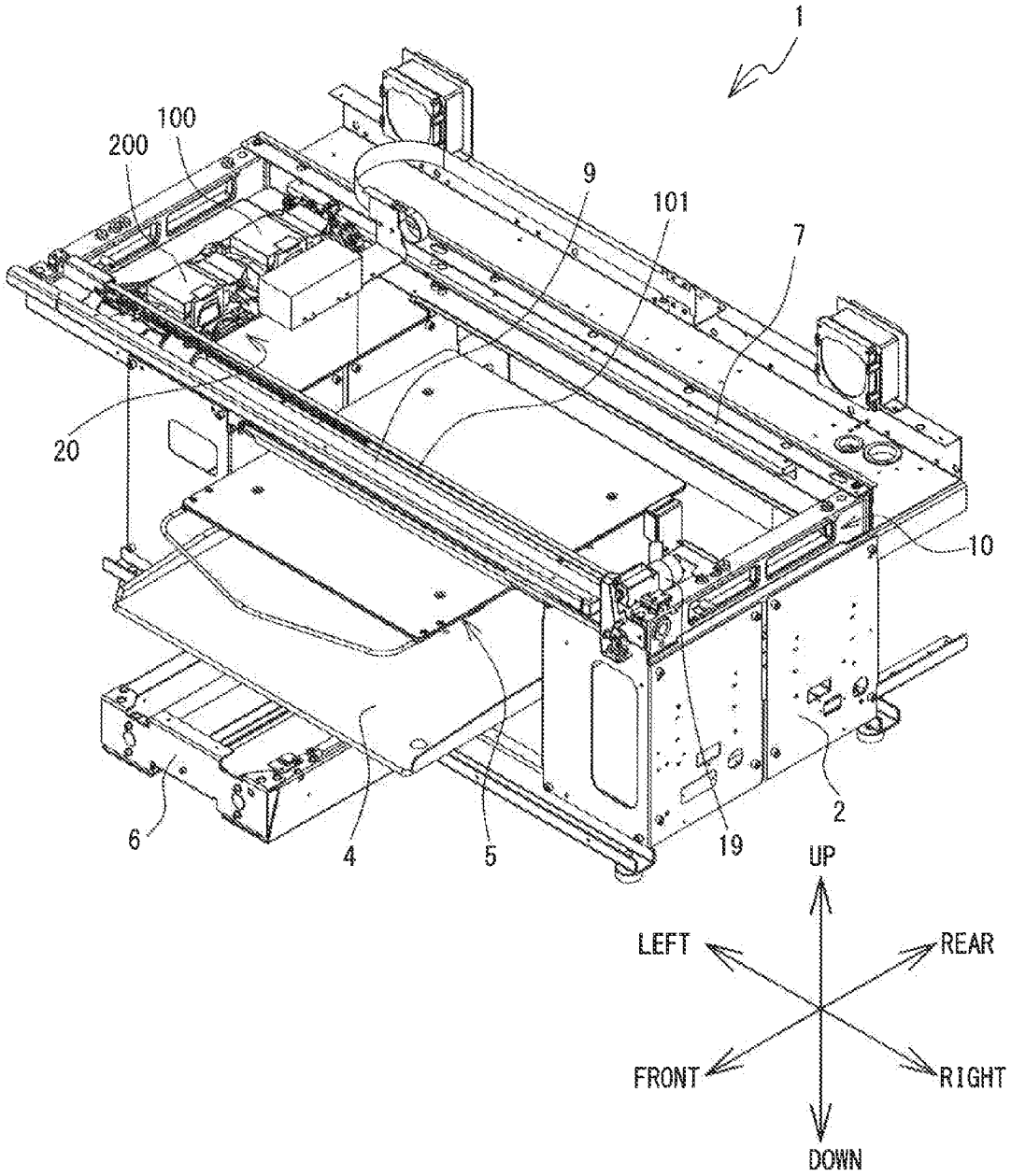
FIG. 1 is a perspective view of a printer.

Referring to FIG. 1 to FIG. 11, a configuration of a printer 1 will be described. In the following description, the terms "up," "down," "right," "left," "front" and "rear" are used in the same meaning as indicated by the respective arrows in the drawing.

As shown in FIG. 1, the printer 1 is an inkjet printer, and configured to inject a liquid ink 97 (see FIG. 2) onto a fabric (not shown) such as a T-shirt, which is a printing medium, and print a desired image on the fabric. The printing media may be paper or the like. In this embodiment, the printer 1 injects five different kinds of ink 97 (white, black, yellow, cyan, and magenta) downward to print a color image on the printing medium. In the following description, the while ink 97 among the five kinds of ink 97 (see FIG. 2) may be referred to as a white ink, and the four colors of ink 97, i.e., black, cyan, yellow and magenta, may collectively be referred to as a color ink. The white ink is high precipitationability liquid that contains a component precipitating faster than the color ink. The component that has high precipitationability is, for example, a pigment such as titanium oxide.

For instance, the white ink is injected onto the fabric, and then the color ink are injected subsequent to the injection of the white ink. The white ink is used as, for example, a foundation when printing an image on the fabric that has a dark ground color. It is also possible to use the white ink in a different printing application than injecting the color ink subsequent to injecting the white ink. Specifically, the fabric surface may include an area injected with the white ink only, and an area injected with the color ink only. For a certain image to be printed, the white ink injection may be subsequent to the color ink injection.

The printer 1 includes a housing 2, a platen drive mechanism 6, a pair of guide rails (not shown), a platen 5, a tray 4, a frame body 10, a guide shaft 9, a rail 7, a carriage 20, head units 100 and 200, a drive belt 101, and a drive motor 19.

The housing 2 has a substantially rectangular parallelepiped shape that has the longitudinal direction in the right-left direction. On the right front of the housing 2, there is provided an operation unit (not shown) for operating the printer 1. The operation unit includes a display and operation buttons. The display is configured to display various pieces of information. An operator operates the operation buttons when the operator enters commands and instructions in connection with desired movements, motions and actions of the printer 1.

The frame body 10 has a frame shape, which has a substantially rectangular shape when viewed from the top, and is located on top of the housing 2. The frame body 10 supports the guide shaft 9 at its front side, and supports the rail 7 at its rear side. The guide shaft 9 is a shaft member that has a shaft portion extending in the right-left direction inside the frame body 10. The rail 7 is a rod-shaped member extending in the right-left direction, and located to face the guide shaft 9.

Figure 2:
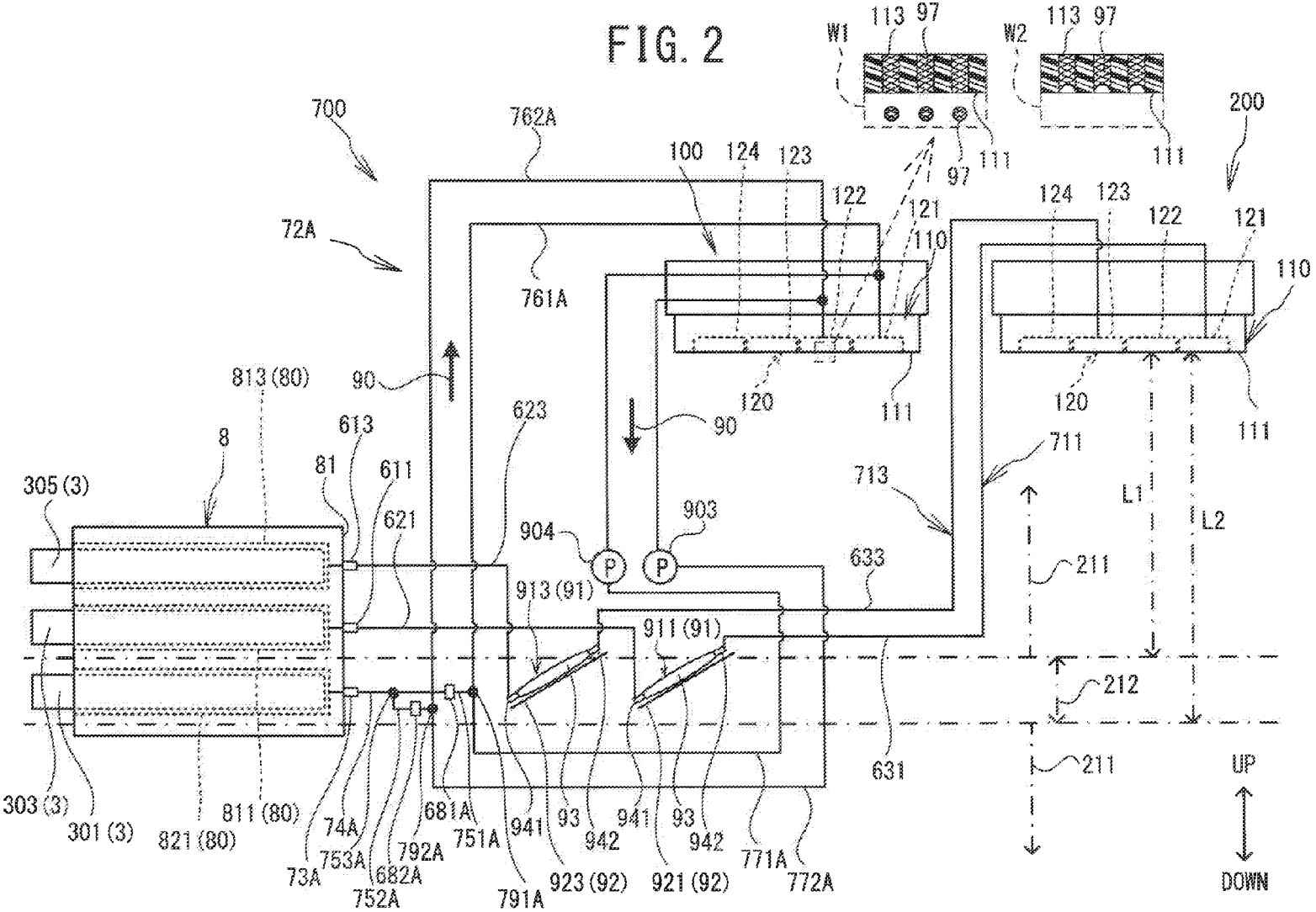
FIG. 2 is a schematic view of part of an ink passage.
Figure 3:
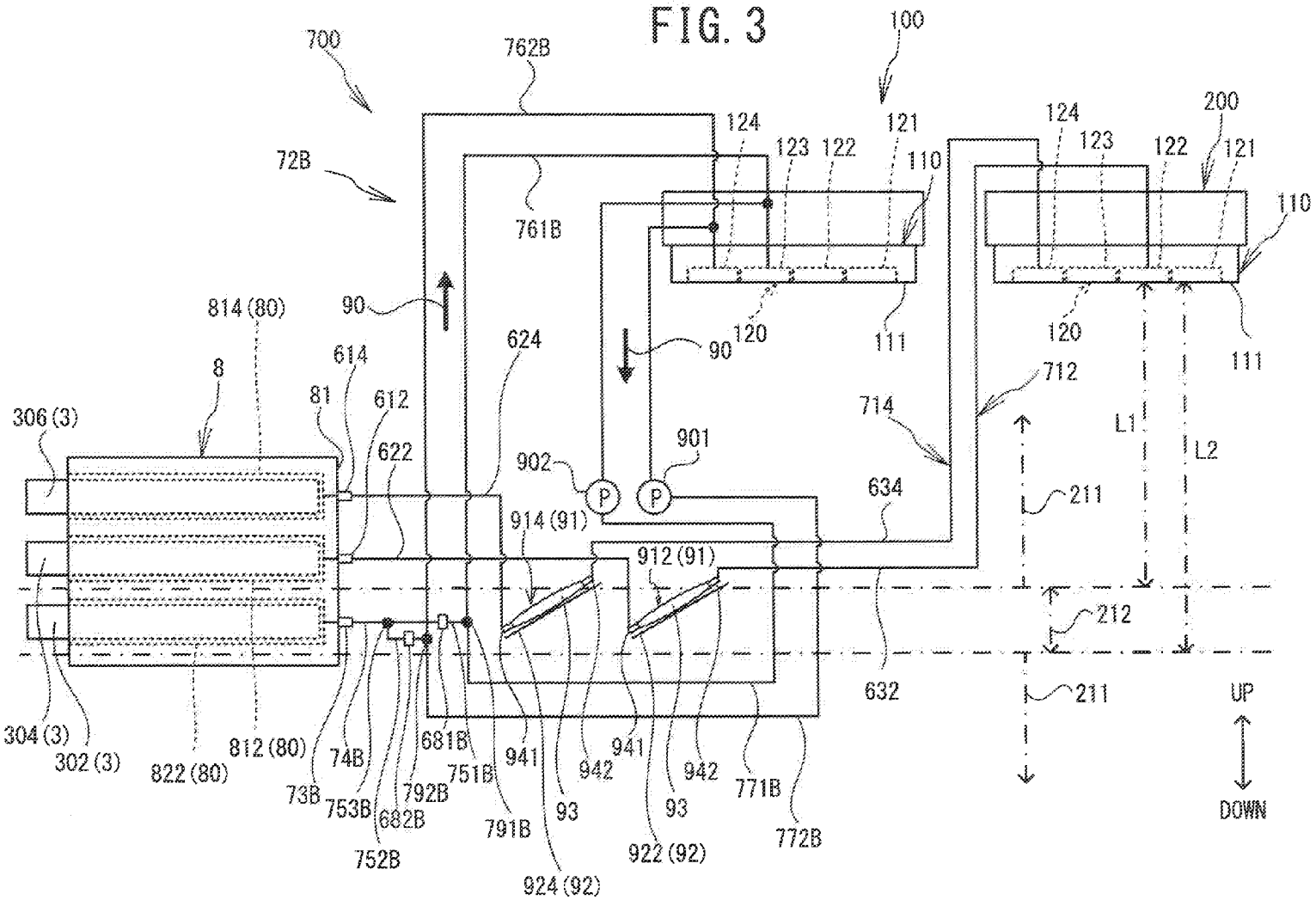
FIG. 3 is a schematic view of another part of the ink passage.

The carriage 20 can move along the guide shaft 9 in the right-left direction. The head units 100 and 200 are arranged in the front-rear direction, and mounted on the carriage 20. The head unit 100 is located behind the head unit 200. As shown in FIG. 2 and FIG. 3, each of the head units 100 and 200 has a head portion 110 at a lower portion thereof. FIG. 2 and FIG. 3 schematically illustrate the vertical locations of respective elements and members of the flow passages of the inks 97. As such, FIG. 2 and FIG. 3 depict the head units 100 and 200 side by side in the drawing sheets although the head units 100 and 200 are in fact viewed from the front. The head portion 110 of the head unit 100 injects the white ink. The head portion 110 of the head unit 200 injects the color ink.

The head portion 110 has a nozzle face 111. The nozzle face 111 is a flat surface that is parallel to the horizontal direction, and includes a plurality of fine nozzles 113 (see FIG. 2) configured to inject the inks 97 downward. The nozzle face 111 defines a bottom face of each of the head units 100 and 200. The nozzles 113 are provided in a nozzle arrangement area 120 of the nozzle face 111. The nozzle arrangement area 120 is formed in a center area of the nozzle face 111 in the right-left direction, and extends in the front-rear direction.

The nozzle face 111 has a plurality of nozzle arrays 121-124. Each of the nozzle arrays 121-124 is an array of a plurality of nozzles 113. Each of the nozzle arrays 121-124 is located in corresponding one of four regions defined by dividing the nozzle arrangement area 120 into four parts in the right-left directions. From the right to the left, there are arranged the nozzle array 121, the nozzle array 122, the nozzle array 123 and the nozzle array 124 in this order.

Each of the nozzle arrays 121-124 of the head unit 100 can inject the white ink. The nozzle arrays 121 and 122 of the head unit 100 are coupled to a single cartridge 301 that reserves the white ink (see FIG. 2 and FIG. 4). The nozzle arrays 123 and 124 of the head unit 100 are coupled to another cartridge 302 that reserves the white ink (see FIG. 3 and FIG. 4).

Figure 4:
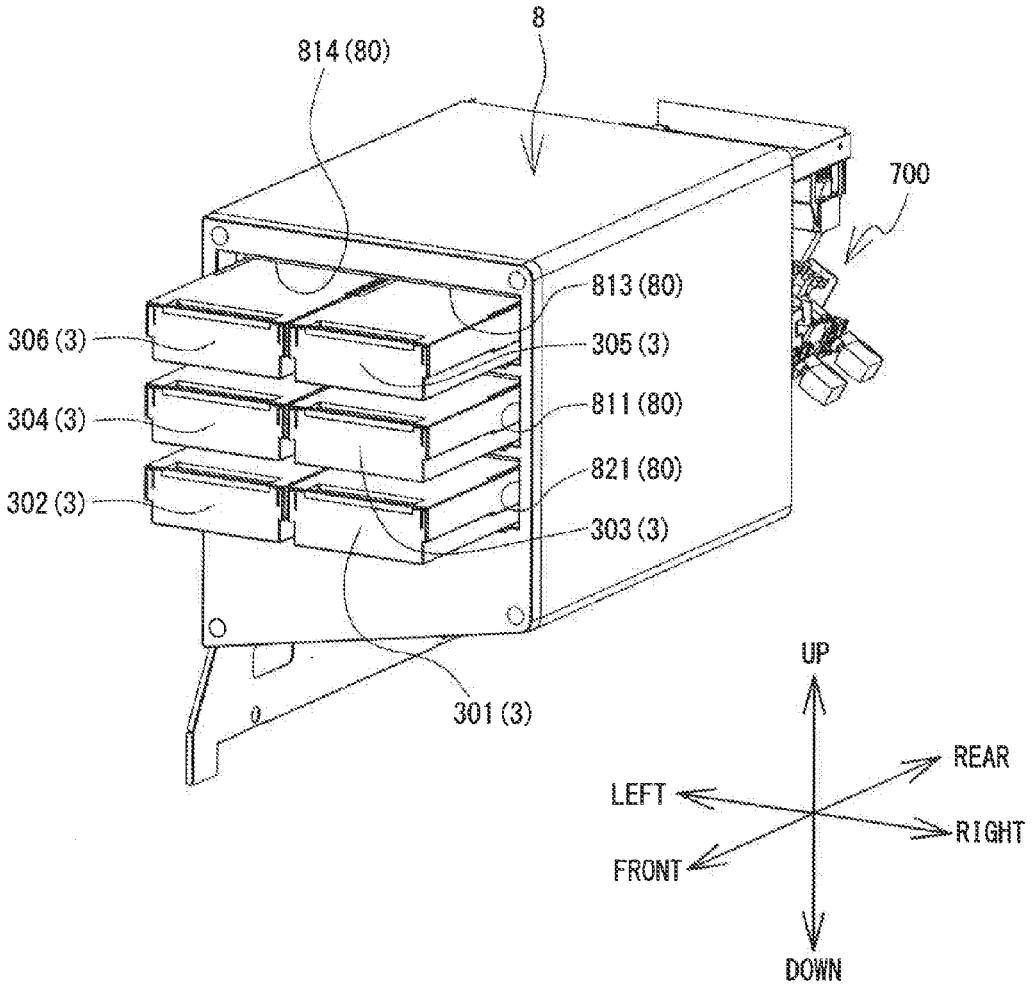
FIG. 4 is a perspective view of a mount frame portion.

As shown in FIG. 2 and FIG. 3, each of the nozzle arrays 121-124 of the head unit 200 is coupled to corresponding one of cartridges 303-306 that retain the color inks. The nozzle array 121 of the head unit 200 is coupled to the cartridge 303 of the magenta ink (see FIG. 2 and FIG. 4), the nozzle array 122 is coupled to the cartridge 304 of the cyan ink (see FIG. 3 and FIG. 4), the nozzle array 123 is coupled to the cartridge 305 of the yellow ink (see FIG. 2 and FIG. 4), and the nozzle array 124 is coupled to the cartridge 306 of the black ink (FIG. 3 and FIG. 4).

As shown in FIG. 1, the drive belt 101 has a strip shape spanning in the right-left direction inside the frame body 10. The drive belt 101 is flexible, and is made from, for example, synthetic resin. The drive motor 19 is provided at the right front area inside the frame body 10, and can rotate in the normal and reverse directions. The drive motor 19 is operatively connected to the carriage 20 via the drive belt 101. As the drive motor 19 drives the drive belt 101, the carriage 20 moves back and forth along the guide shaft 9 in the right-left direction. Accordingly, the head units 100 and 200 move back and forth in the right-left direction, and inject the inks 97 toward the platen 5 that is located below the head units 100 and 200 and faces the head units 100 and 200.

The platen drive mechanism 6 has a pair of guide rails (not shown) and a platen support (not shown). The two guide rails extend in the front-rear direction inside the platen drive mechanism 6, and support the platen support such that the platen support can move in the front-rear direction. The platen support is configured to support the platen 5 at an upper portion thereof. The platen 5 supports the printing medium.

The tray 4 is provided below the platen 5. The tray 4 supports sleeves of the T-shirt when the operator puts the T-shirt on the platen 5. Thus, the sleeves of the T-shirt do not contact components other than the tray in the housing 2.

The platen drive mechanism 6 is configured to be driven by a motor (not shown) provided at a rear end of the printer 1. The platen drive mechanism 6 is configured to move the platen support and the platen 5 in the front-rear direction of the housing 2 along the paired guide rails. As the platen 5 transports the printing medium in the front-rear direction (sub-scanning direction) and the head portion 110 injects the inks 97 while moving in the right-left direction in the reciprocal manner, the printer 1 prints on the printing medium.

A mount frame portion 8 shown in FIG. 4 is provided on the right side of the printer 1. The mount frame portion 8 is supported by the housing 2 (not shown in FIG. 4). The mount frame portion 8 has a plurality of mount portions 80, and each of the mount portions 80 is configured to mount the cartridge 3. Each mount portion 80 is a recess that has a rectangular parallelepiped shape, and is concave in the rear direction from the front face of the mount frame portion 8. The inner rear end of each mount portion 80 has a hollow needle (not shown) extending toward the front. As the cartridge 3 is mounted in the mount portion 80, the hollow needle sticks in a rubber lid (not shown) provided at a mouth plug 70 (see FIG. 5) of a liquid container 31 received in the cartridge 3. The hollow needle draws out the ink 97 from the liquid container 31 (see FIG. 5) held in the cartridge 3.

Figure 5:
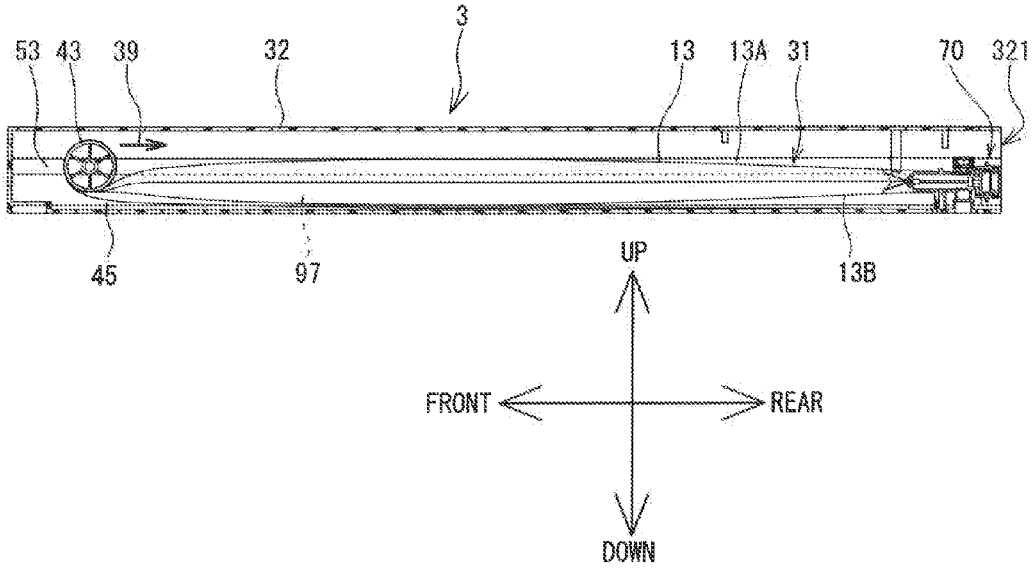
FIG. 5 is a vertical cross-sectional view of a cartridge.

As shown in FIG. 5, the cartridge 3 has a casing 32, the liquid container 31, a shaft 43, and a resilient member 45. The casing 32 is a rectangular parallelepiped, which is generally elongated in the front-rear direction. The casing 32 has an opening 321 at its rear end. The liquid container 31 is located in the casing 32. The liquid container 31 has a liquid bag 13 and the mouth plug 70. The liquid bag 13 is a bag-like container formed by placing rectangular flexible sheets 13A and 13B one after another, which are made from synthetic resin or the like, such that one face of one of the sheets faces one face of the other sheet, and heating and fusing the peripheries of the two sheets (by means of thermal seal) to connect the two sheets 13A and 13B to each other. The liquid bag 13 extends in the front-rear direction. The mouth plug 70 is attached to the rear end of the liquid bag 13, and is exposed rearward from the opening 321 of the casing 32. The mouth plug 70 is a cylindrical element extending in the rear direction, and a rubber plug (not shown) located in the mouth plug 70 provides a seal such that the ink 97 in the liquid bag 13 does not leak.

The shaft 43 has a cylindrical shape extending in the right-left direction. The shaft 43 has projections (not shown) at right and left ends thereof such that the projections project outwardly in the right and left directions respectively. The projections are located in recesses 53 provided at right and left side faces in the casing 32. The recesses 53 are depressed outwardly in the right and left directions, respectively, and extend in the front-rear direction. The resilient member 45 extend on the bottom face in the front-rear direction inside the casing 32. A rear end of the resilient member 45 is secured to a rear portion of the casing 32, and a front end of the resilient member 45 is wound around the shaft 43 such that the resilient member 45 biases the shaft 43 and exerts a returning force in the rear direction. Thus, the shaft 43 winds up the liquid bag 13 and collects the ink 97 toward the mouth plug 70 as the shaft 43 moves in the rear direction. In other words, the shaft 43 moves in the rear direction as the remaining amount of ink 97 in the liquid container 31 decreases (see the arrow 39 in FIG. 5).

The ink 97 is supplied to the nozzle face 111 from the cartridge 3 engaged in the mount portion 80. As shown in FIG. 2 and FIG. 3, a region in the up-down direction is referred to as a first region 211. The first region 211 is a region in which a distance from the nozzle face 111 in the up-down direction is out of a predetermined range. Also, a region in the up-down direction is referred to as a second region 212. The second region 212 is a region in which a distance from the nozzle face 111 in the up-down direction is in the predetermined range. In this embodiment, the predetermined range is a range in which a distance measured from the nozzle face 111 in the downward direction falls within a range between the distances L1 and L2. For example, L1 is 10 mm and L2 is 50 mm. As shown in the enlarged view W2 in FIG. 2, a meniscus is created at the nozzle face 111 by the surface tension, i.e., the ink 97 is concave in the nozzle 113. The meniscus holds the ink 97 at the nozzle face 111. When the ink 97 is supplied toward the nozzle face 111 from the second region 212, which is the predetermined range apart from the nozzle face 111 by the predetermined distance in the up-down direction, the meniscus is difficult to break, and it is possible to properly inject the ink 97.

Figure 6:
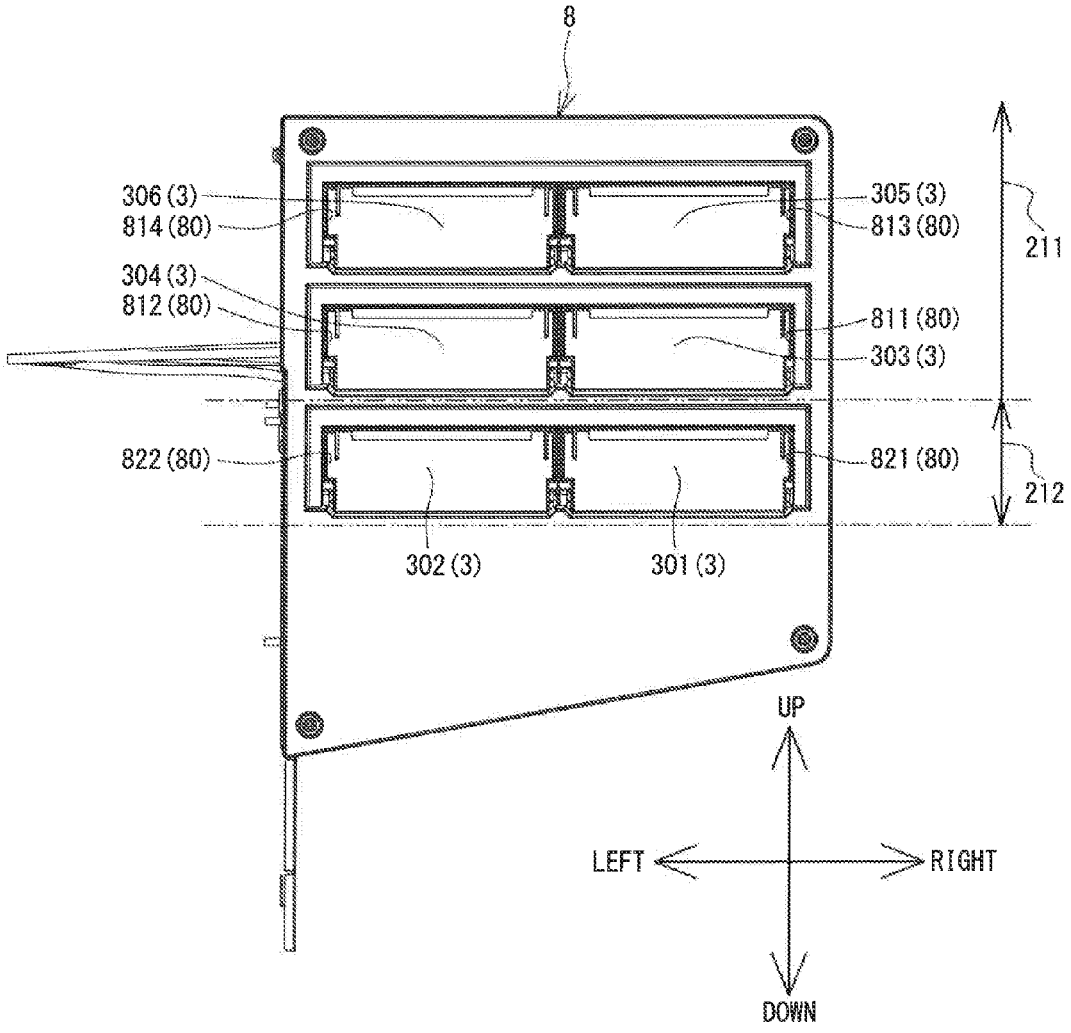
FIG. 6 is a front view of the mount frame portion.

As shown in FIG. 4 and FIG. 6, the mount portions 80 are arranged in two columns side by side in the right-left direction and in three tiers in the up-down direction. As shown in FIG. 2, FIG. 3 and FIG. 6, the mount portions 80 includes first mount portions 811-814 located in the first region 211, and second mount portions 821 and 822 located in the second region 212. In this embodiment, the second mount portions 821 and 822 are located below the first mount portions 811-814. Specifically, as shown in FIG. 6, the second mount portion 821 is located at the lower right area of the mount frame portion 8, and the second mount portion 822 is located on the left of the second mount portion 821. The first mount portions 811 and 812 are located above the second mount portions 821 and 822, respectively, and the first mount portions 813 and 814 are located above the first mount portions 811 and 812, respectively.

The second mount portions 821 and 822 can mount the cartridges 301 and 302, respectively. Each of the cartridges 301 and 302 contains the white ink, which is the high precipitationability liquid. The first mount portions 811-814 can mount the cartridges 303-306, respectively. The cartridges 303-306 contain the color inks.

Figure 7:
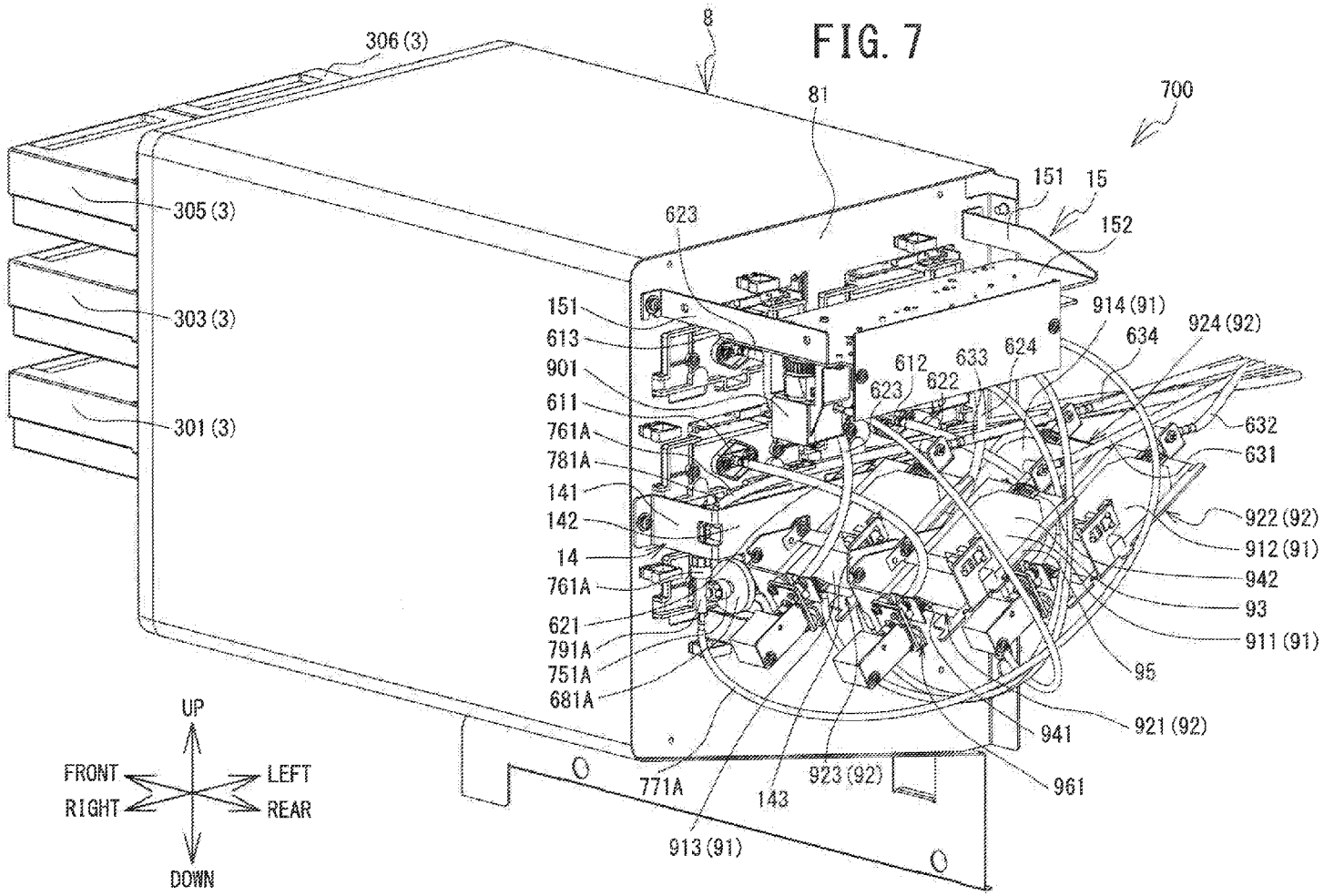
FIG. 7 is a perspective view of the mount frame portion and the ink passage.
Figure 8:
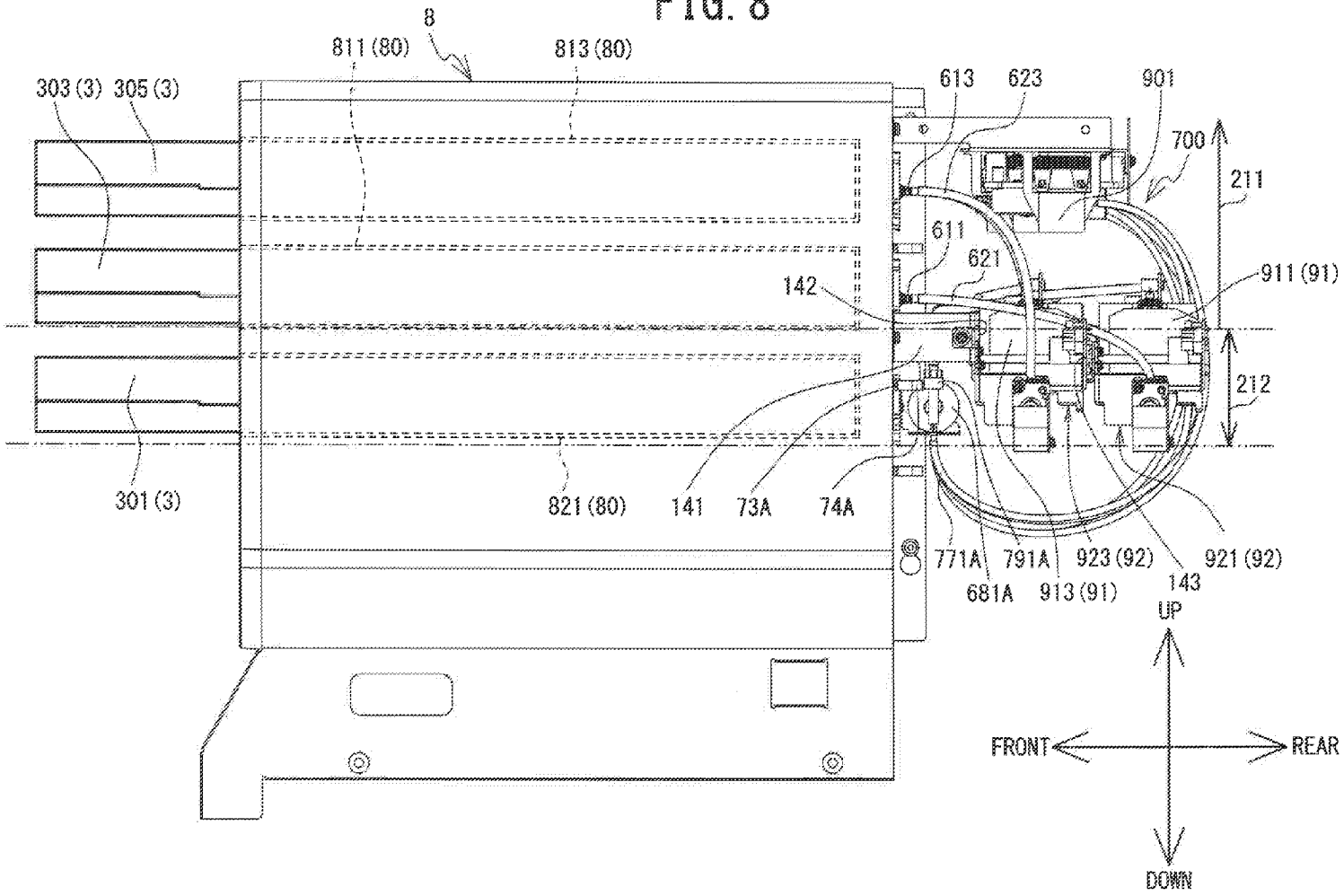
FIG. 8 is a right side view of the mount frame portion and the ink passage.

As shown in FIG. 7 and FIG. 8, four sub-tanks 91 and four sub-tank supports 92 are provided behind the mount frame portion 8. The sub-tanks 91 and the sub-tank supports 92 are located such that they face the second mount portions 821 and 822 in the horizontal direction. As shown in FIG. 2, FIG. 3 and FIG. 8, the sub-tanks 91 are located in the second region 212. FIG. 2 and FIG. 3 schematically show the positions of the respective members of the flow passage of the ink 97 in the up-down direction. The directions of the sub-tank(s) 91 and the sub-tank support(s) 92 may be different from the directions shown in FIG. 7. The sub-tanks 91 define reservoir passages 711-714, which will be described later (see FIG. 2 and FIG. 3), and can reserve the ink 97 to be supplied to the nozzle face 111 from the cartridge 3.

As shown in FIG. 2 and FIG. 7, the sub-tank 91 has a bag 93 and mouth plugs 941 and 942. In FIG. 7, the reference numerals of the bag 93 and the mouth plugs 941 and 942 are only shown for the sub-tank 911 (will be described). The bag 93 is a bag-shaped container formed by folding a rectangular-shaped flexible sheet made from a material such as synthetic resin and jointing the peripheries of the peripheral portions of the folded sheet by heating and fusing (by means of thermal seal) to provide the bag. It should be noted that the bag 93 may be a bag-like container formed by placing rectangular flexible sheets one after another, which are made from synthetic resin or the like, such that one face of one of the sheets faces one face of the other sheet, and heating and fusing the peripheries of the two sheets (by means of thermal seal) to connect the two sheets to each other. The mouth plug 941 is provided at one end in the longitudinal direction of the bag 93. The mouth plug 942 is provided at the other end in the longitudinal direction of the bag 93.

The sub-tank support 92 is a member to support the sub-tank 91. As shown in FIG. 7, the sub-tank support 92 has a support plate portion 95 and a valve portion 961. In FIG. 7, the reference numerals of the support plate portion 95 and the valve portion 961 are only shown for the sub-tank support 921, which will be described later. The support plate portion 95 is a plate-like member, and supports the sub-tank 91 on its upper face. The valve portion 961 is located at the right end of the support plate portion 95, and connects to any of the first connection passages 621-624 (will be described later) and to the mouth plug 941 of the sub-tank 91.

The support plate portion 14 is provided on the back face 81 of the mount frame portion 8. The support plate portion 14 supports the sub-tank support 92. As shown in FIG. 7 to FIG. 9 and FIG. 11, the support plate portion 14 has a first plate portion 141, a second plate portion 142, and a third plate portion 143. The first plate portion 141 extends rearward from a right end of the rear face 81 of the mount frame portion 8 in the right-left direction, between the first mount portions 811, 812 and the second mount portions 821, 822 in the up-down direction and. The second plate portion 142 connects to the rear end of the first plate portion 141 and extends in the right-left direction. Thus, the second plate portion 142 is situated behind the mount frame portion 8. The third plate portion 143 extends in the right-left direction behind the second plate portion 142. The lower right end of the third plate portion 143 is coupled to the lower right end of the second plate portion 142 by a plate element (not shown) extending in the front-rear direction. The left end of the support plate portion 14 is supported by a frame member (not shown).

The four sub-tank supports 92 and the four sub-tanks 91 are arranged in two columns side by side in the right-left direction and in two tiers in the front-rear direction. The four sub-tanks 91 are assigned reference numerals 911, 912, 913 and 914, respectively (i.e., sub-tanks 911-914), in the following description. The four sub-tank supports 92 for supporting the four sub-tanks 911-914 are assigned reference numerals 921, 922, 923 and 924 (sub-tank supports 921-924), respectively.

As shown in FIG. 7, the sub-tank 913 and the sub-tank support 923 are situated behind the second mount portion 821 (see FIG. 6). The sub-tank 914 and the sub-tank support 924 are situated behind the second mount portion 822 (see FIG. 6). The sub-tank supports 923 and 924 connect to the second plate portion 142 of the support plate 14.

The sub-tank 911 and the sub-tank support 921 are situated behind the sub-tank 913 and the sub-tank support 923. The sub-tank 912 and the sub-tank support 922 are situated behind the sub-tank 914 and the sub-tank support 924. The third plate portion 143 of the support plate 14 is situated behind the sub-tank supports 923 and 924. The sub-tank supports 921 and 922 connect to the third plate 143, respectively. The sub-tank 91 and the sub-tank support 92 incline to the diagonally upward left direction relative to the horizontal plane.

Figure 9:
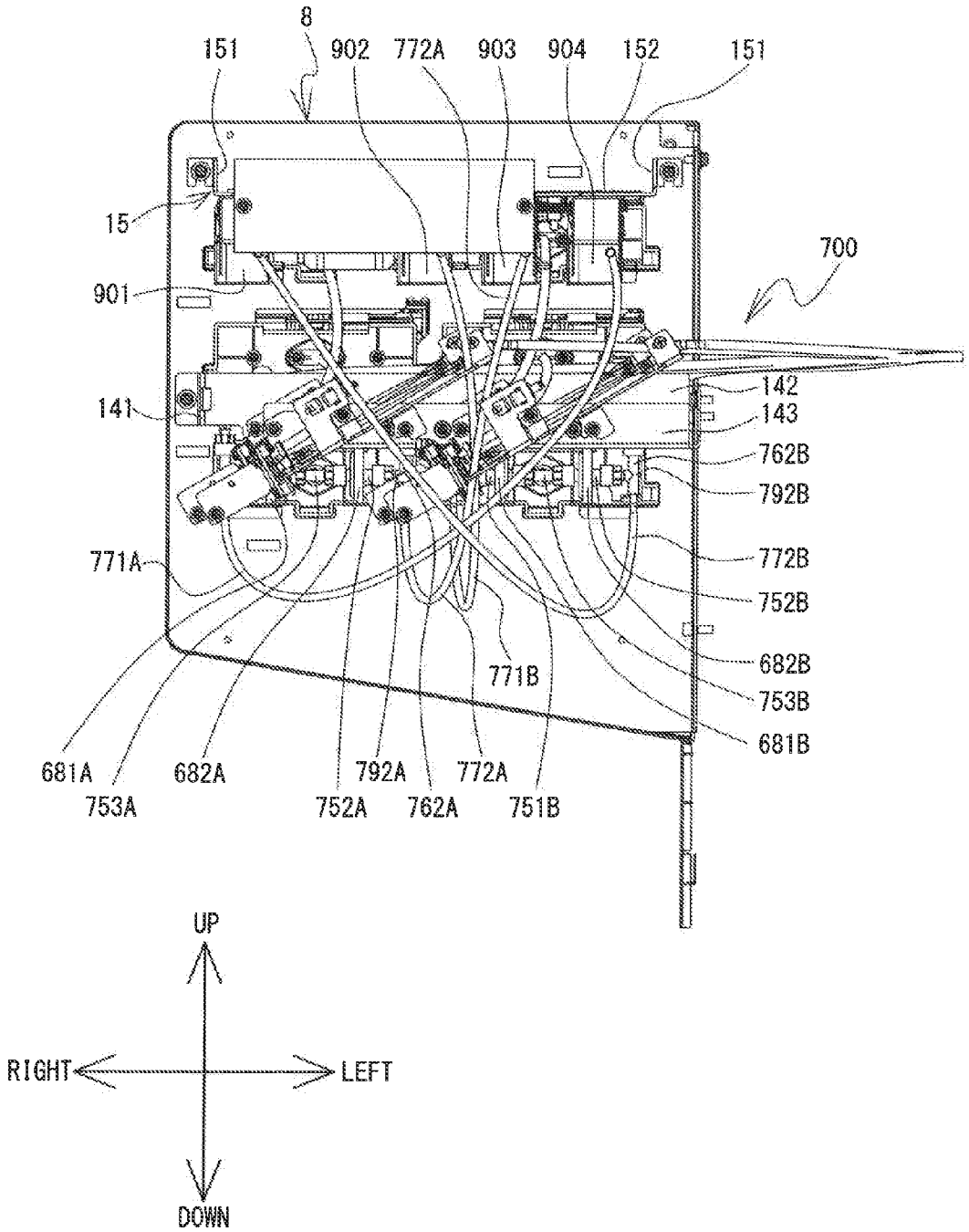
FIG. 9 is a back view of the mount frame portion and the ink passage.

As shown in FIG. 7 and FIG. 9, a pump support 15 is attached to the back face 81 of the mount frame portion 8. The pump support 15 supports the pumps 901-904 (see FIG. 9). As shown in FIG. 7, the pump support 15 has a pair of first support plate portions 151 and a second support plate portion 152. The pair of the first support plate portions 151 respectively extend rearward from the right and left ends of the back face 81 of the mount frame portion 8 in the right-left direction, above the first mount portions 813 and 814. The second support plate portion 152 connects to the rear lower ends of the pair of the first support plate portions 151, and extends in the right-left direction. The second support plate portion 152 is generally parallel to the horizontal direction.

As shown in FIG. 9, the four pumps 901-904 connect to the bottom face of the second support plate portion 152 of the pump support 15, and are arranged in the left direction from the right side. Thus, the four pumps 901-904 are situated behind the mount frame portion 8. In FIG. 9, fluid passages that connect the pumps 901-904 to the head portion 110 are not shown.

The ink passage arrangement 700 will be described. As shown in FIG. 2 and FIG. 3, the ink passage arrangement 700 has reservoir passages 711-714 and non-reservoir passages 72A, 72B. FIG. 2 illustrates the fluid passages which are connected to the first mount portions 811 and 813 and the second mount portion 821 on the right column in FIG. 6. FIG. 3 illustrates the fluid passages which are connected to the first mount portions 812 and 814 and the second mount portion 822 on the left column in FIG. 6.

The reservoir passages 711-714 are fluid passages that connect the first mount portions 811-814 to the head portion 110 of the head unit 200, respectively. The reservoir passages 711-714 have sub-tanks 911-914, respectively. The color inks, which are not high precipitationability fluid, flow in the reservoir passages 711-714. The non-reservoir passages 72A and 72B are fluid passages that connect the second mount portions 821 and 822 to the head portion 110 of the head unit 100, respectively. The non-reservoir passages 72A and 72B do not have sub-tanks 911-914. The non-reservoir passages 72A and 72B are fluid passages through which the white ink (i.e., the high precipitationability fluid) flows.

The reservoir passages 711-714 will now be described. The reservoir passages 711-714 include fluid feed ports 611-614, first connection passages 621-624, second connection passages 631-634, and sub-tanks 911-914, respectively. The fluid feed ports 611-614 are provided behind the first mount portions 811-814 at the rear face 81 of the mount frame portion 8, respectively. The fluid feed ports 611-614 connect to the hollow needles (not shown) provided in the first mount portions 811-814 via fluid passages (not shown), respectively. The fluid feed ports 611-614 feed the ink 97 to the head portion 110 from the first mount portions 811-814.

As illustrated in FIG. 2, FIG. 3, FIG. 7 and FIG. 10, one end of each of the first connection passages 621-624 connects to the associated fluid feed port 611, 612, 613, 614. The first connection passages 621-624 extend to the sub-tanks 911-914 located in the second region 212, respectively. The other end of each of the first connection passages 621-624 connects to a valve portion 961 (see FIG. 7) of the associated sub-tank support 921, 922, 923, 924, and in turn to the mouth plug 941 of the associated sub-tank 911, 912, 913, 914. The valve portion 961 has a fluid passage that connects the associated first connection passage 621, 622, 623, 624 to the corresponding mouth plug 941. The valve portion 961 is equipped with a solenoid valve (not shown), and the solenoid valve opens and closes the fluid passage, which extends from the associated first connection passage 621, 622, 623, 624 to the corresponding mouth plug 941, under the control of a CPU (not shown). Accordingly, the printer 1 can adjust an amount of the ink 97 to be introduced into the sub-tank 91.

One end of each of the second connection passages 631-634 connects to the mouth plug 942 of the associated sub-tank 911, 912, 913, 914. The other end of each second connection passage 631, 632, 633, 634 connects to the head portion 110 of the head unit 200, and in turn to the associated nozzle array 121, 122, 123, 124 of the nozzle face 111 (see FIG. 2 and FIG. 3).

Figure 11:
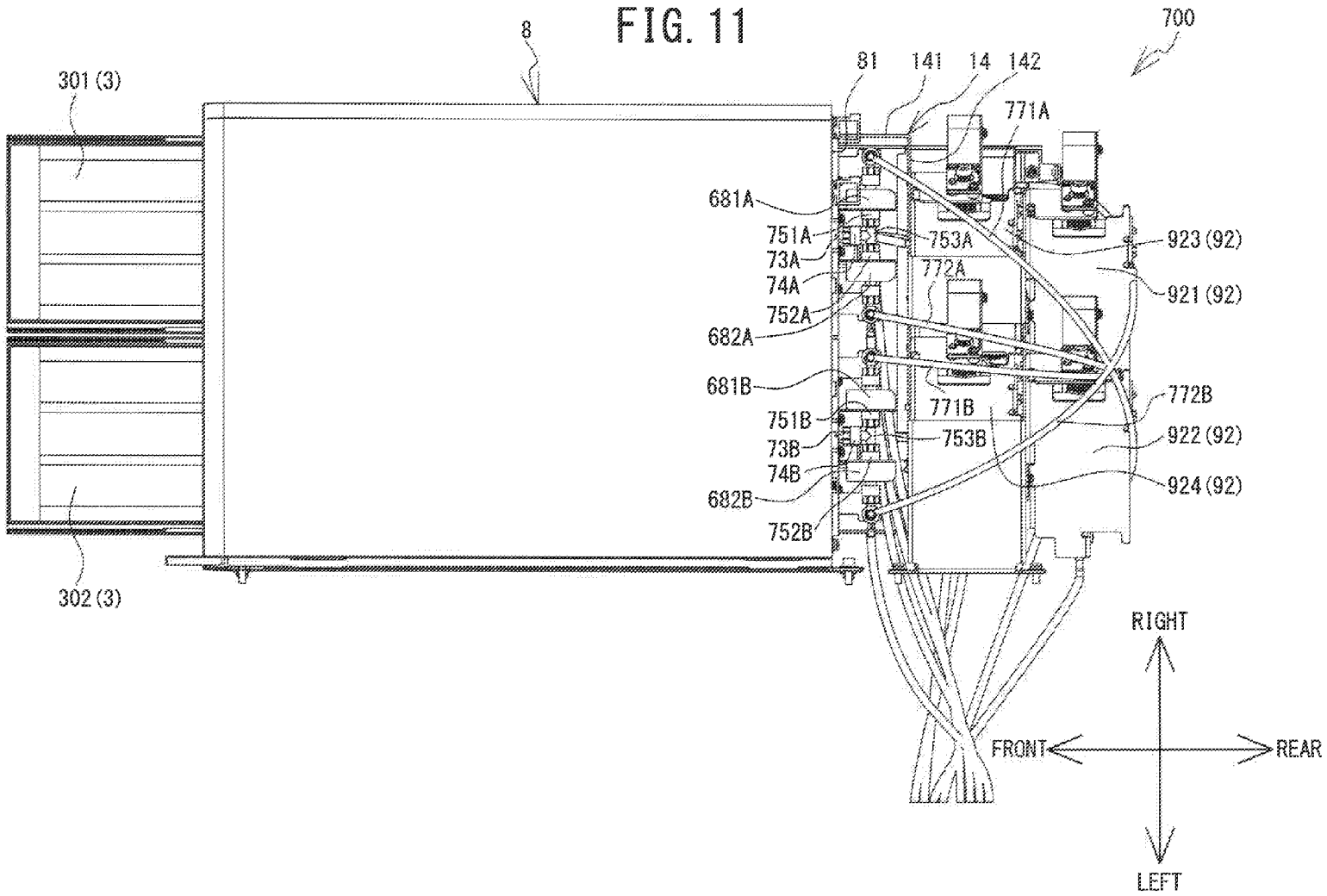
FIG. 11 is a bottom view of the mount frame portion and the ink passage.

The non-reservoir passages 72A and 72B will be described. As shown in FIG. 2, the non-reservoir passage 72A has the liquid feed port 73A, a common passage 74A, branch passages 751A and 752A, filter portions 681A and 682A, a first branch portion 753A, second branch portions 791A and 792A, and feed passages 761A and 762A. Circulation passages 771A and 772A connect to the non-reservoir passage 72A. As shown in FIG. 2, FIG. 8 and FIG. 11, the liquid feed port 73A is provided behind the second mount portion 821 at the rear face 81 of the mount frame portion 8. The liquid feed port 73A connects to the hollow needle provided in the second mount portion 821 via a fluid passage (not shown). The liquid feed port 73A feeds the ink 97 to the head portion 110 from the second mount portion 821.

The common passage 74A connects to the liquid feed port 73A, and extends in the rear direction toward the sub-tank 91 from the second mount portion 821. The branch passages 751A and 752A connect to the rear end of the common passage 74A. The branch portion of the common passage 74A that branches to the branch passages 751A and 752A is referred to as a first branch portion 753A (see FIG. 2 and FIG. 11). The first branch portion 753A is situated between the second mount portion 821 and the sub-tank 913.

As shown in FIG. 11, the branch passage 751A extends to the right from the first branch portion 753A. Specifically, the first branch portion 753A defines a bend portion that bends in the right direction and that is formed on the non-reservoir passage 72A. The right direction crosses the rear direction extending from the second mount portion 821 to the sub-tank 91. The branch passage 752A extends to the left from the first branch portion 753A. Specifically, the first branch portion 753A defines a bend portion that bends in the left direction and that is formed on the non-reservoir passage 72A. The left direction crosses the rear direction extending from the second mount portion 821 to the sub-tank 91.

As depicted in FIG. 2, FIG. 7 and FIG. 8, the feed passage 761A and the circulation passage 771A connect to the right end of the branch passage 751A. The branch portion of the branch passage 751A that branches to the feed passage 761A and the circulation passage 771A is referred to as a second branch portion 791A. The filter portion 681A is provided at a fluid passage between the second mount portion 821 and the second branch portion 791A. In this embodiment, the filter portion 681A is provided at the branch passage 751A. The filter portion 681A has a disk shape. The filter portion 681A possesses a higher passage resistance than a passage resistance of the circulation passage 771A. The filter portion 681A reduces the possibility of foreign matters, which is contained in the ink 97, flowing to the downstream. This is also true to filter portions 682A, 681B and 682B (will be described later).

The feed passage 761A extends upward from the second branch portion 791A. Specifically, the second branch portion 791A defines a bend portion that bends in the up direction crossing the right direction at the non-reservoir passage 72A. The feed passage 761A extends upward from the second branch portion 791A, and then bends to the left at the bend portion 781A (see FIG. 7 and FIG. 10). As shown in FIG. 2, the feed passage 761A connects to the head portion 110 of the head unit 100, and in turn to the nozzle 113 arranged in the nozzle array 121. As shown in FIG. 7, the second branch portion 791A and the bend portion 781A are provided on the non-reservoir passage 72A at positions closer to the head portion 110 than the first branch portion 753A (see FIG. 11), i.e., provided on the downstream side, such that the second branch portion 791A and the bend portion 781A are situated between the mount portion 80 and the sub-tank 91 in the horizontal direction.

The circulation passage 771A is a fluid passage through which the white ink, i.e., the high precipitationability liquid from the non-reservoir passage 72A, circulates. The diameter of the circulation passage 771A is smaller than the diameter of the non-reservoir passage 72A. As shown in FIG. 2 and FIG. 7, one end of the circulation passage 771A connects to the feed passage 761A of the non-reservoir passage 72A at the second branch portion 791A, and the other end of the circulation passage 771A connects to the feed passage 761A at the head unit 100. The second branch portion 791A is situated closer to the second mount portion 821 than the head unit 100. As shown in FIG. 2 and FIG. 9, the pump 904 (see FIG. 9) is provided on the circulation passage 771A, and the white ink (i.e., high precipitationability liquid) is caused to circulate through the non-reservoir passage 72A (feed passage 761A) as the pump 904 is activated.

As shown in FIG. 2 and FIG. 7, the circulation passage 771A extends downward from the second branch portion 791A, and then extends below and behind the sub-tank 91 and the sub-tank support 92. The circulation passage 771A then extends to the head unit 100 via the pump 904 (see FIG. 9). As such, part of the circulation passage 771A is situated below the sub-tank 91.

As shown in FIG. 2 and FIG. 9, the feed passage 762A and the circulation passage 772A connect to the left end of the branch passage 752A. A branch portion of the branch passage 752A, which branches to the feed passage 762A and the circulation passage 772A, is referred to as a second branch portion 792A. The filter portion 682A is provided on the branch passage 752A. The filter portion 682A has a disk shape. The filter portion 682A has a higher passage resistance than a passage resistance of the circulation passage 772A.

The feed passage 762A extends upward from the second branch portion 792A. Specifically, the second branch portion 792A defines a bend portion that bends in the up direction crossing the left direction at the non-reservoir passage 72A. The feed passage 762A extends upward from the second branch portion 792A, and then bends to the left at the bend portion 782A (see FIG. 10). As shown in FIG. 2, the feed passage 762A connects to the head portion 110 of the head unit 100, and in turn to the nozzle 113 arranged in the nozzle array 122. The second branch portion 792A and the bend portion 782A are provided on the non-reservoir passage 72A at positions closer to the head portion 110 than the first branch portion 753A, i.e., on the downstream side. The second branch portion 792A and the bend portion 782A are situated between the mount portion 80 and the sub-tank 91 in the horizontal direction.

The circulation passage 772A is a fluid passage through which the white ink, i.e., the high precipitationability liquid from the non-reservoir passage 72A, circulates. The diameter of the circulation passage 772A is smaller than the diameter of the non-reservoir passage 72A. As shown in FIG. 2 and FIG. 9, one end of the circulation passage 772A connects to the feed passage 762A of the non-reservoir passage 72A at the second branch portion 792A, and the other end of the circulation passage 772A connects to the feed passage 762A at the head unit 100. The pump 903 (see FIG. 9) is provided on the circulation passage 772A, and the white ink, i.e., the high precipitationability liquid, circulates in the non-reservoir passage 72A (feed passage 762A) as the pump 903 is activated.

The circulation passage 772A extends downward from the second branch portion 792A, and then extends below and behind the sub-tank 91 and the sub-tank support 92. The circulation passage 772A then extends to the head unit 100 via the pump 903 (see FIG. 9). As such, part of the circulation passage 772A is situated below the sub-tank 91. The second branch portion 792A is situated closer to the second mount portion 821 than the head unit 100.

Figure 10:
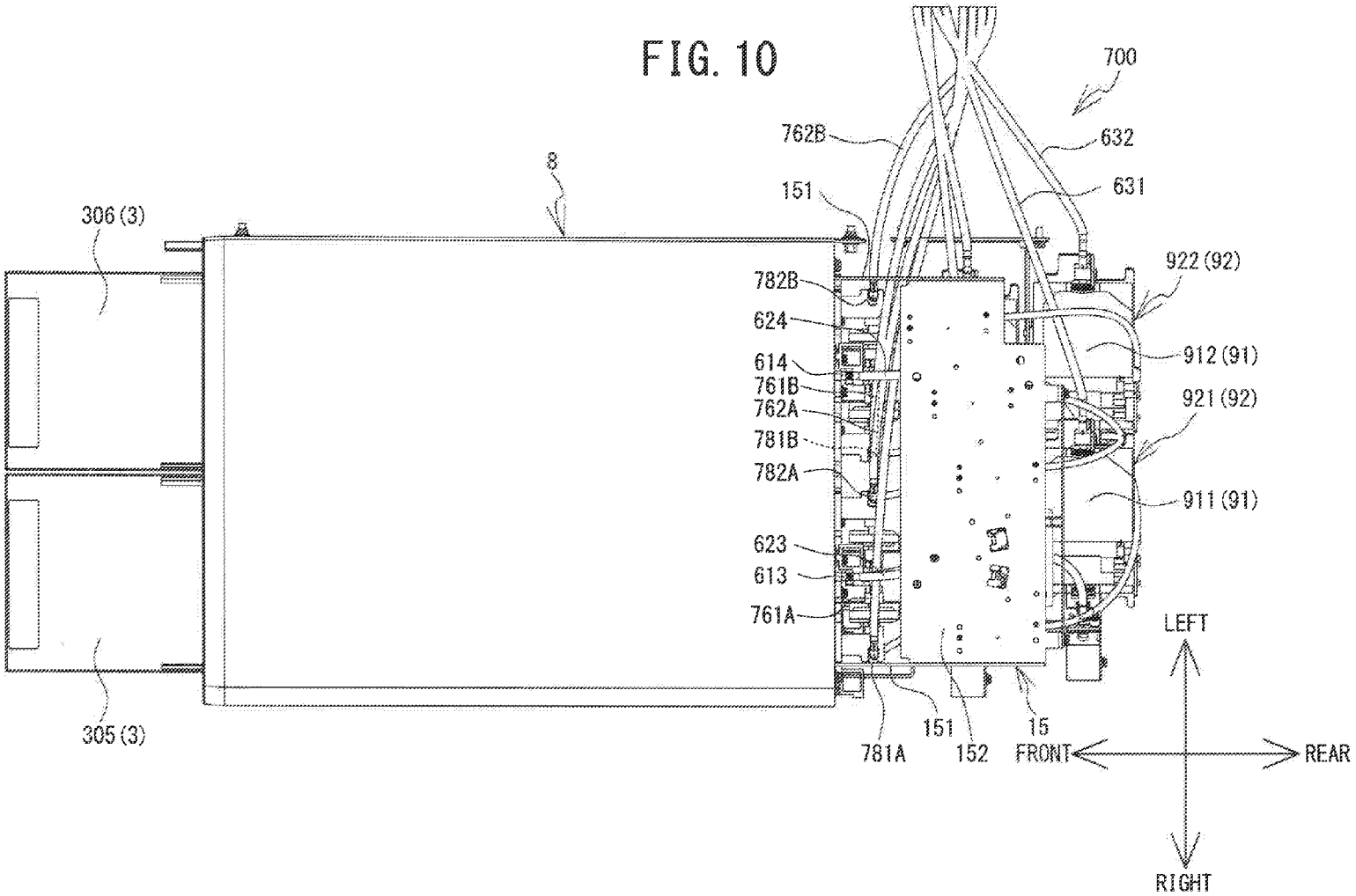
FIG. 10 is a plan view of the mount frame portion and the ink passage.

As shown in FIG. 3, the non-reservoir passage 72B has a liquid feed port 73B, a common passage 74B, branch passages 751B and 752B, filter portions 681B and 682B, a first branch portion 753B, second branch portions 791B and 792B, and feed passages 761B and 762B. The circulation passages 771B and 772B are connected to the non-reservoir passage 72B. The structures of these components and elements will not be described because the structures of these components and elements are similar to those of the liquid feed port 73A, the common passage 74A, the branch passages 751A and 752A, the first branch portion 753A, the filter portions 681A and 682A, the second branch portions 791A and 792A, the feed passages 761A and 762A, and the circulation passages 771A and 772A of the non-reservoir passage 72A shown in FIG. 2. As shown in FIG. 10, the non-reservoir passage 72B has bend portions 781B and 782B that are similar to the bend portions 781A and 782A. The feed passages 761B and 762B extend upwards, and then bends to the left to define the bend portions 781B and 782B. The liquid feed port 73B feeds the ink 97 to the head portion 110 from the second mount portion 822. The feed passages 761B and 762B connect to the nozzle arrays 123 and 124 of the head unit 100, respectively. The liquid feed port 73B feeds the ink 97 to the head portion 110 from the second mount portion 822. The pumps 901 and 902 are provided on the circulation passages 772B and 771B, respectively. The filter portions 681B and 682B have higher passage resistances than the passage resistances of the circulation passages 771B and 772B, respectively.

The flow of the ink 97 when a printing operation, which injects the ink 97 from the nozzle face 111 for printing, is carried out and a circulating operation, which drives the pumps 901-904 to circulate the white ink (i.e., high precipitationability liquid), is carried out will be described. The printing operation and the circulating operation are carried out as the CPU (not shown) of the printer 1 controls the printer 1 in accordance with a control program stored in a storage unit (not shown).

In the printing operation, as shown in the enlarged view W1 in FIG. 2, the ink 97 is injected from the nozzle 113 of the nozzle face 111 as a piezo-electric device (not shown) provided at the heat part 110 is activated. The movement of the ink 97 injected from the nozzle 113 serves as a pumping force, which pulls the ink 97 toward the nozzle face 111. Thus, as shown in FIG. 2, the white ink is supplied to the nozzle array 121 of the head unit 100 from the cartridge 301 through the liquid feed port 73A, the common passage 74A, the branch passage 751A and the feed passage 761A. The white ink is supplied to the nozzle array 122 of the head unit 100 from the cartridge 301 through the liquid feed port 73A, the common passage 74A, the branch passage 752A and the feed passage 762A. As shown in FIG. 3, the white ink is supplied to the nozzle array 123 of the head unit 100 from the cartridge 302 through the liquid feed port 73B, the common passage 74B, the branch passage 751B and the feed passage 761B. The white ink is supplied to the nozzle array 124 of the head unit 100 from the cartridge 302 through the liquid feed port 73B, the common passage 74B, the branch passage 752B and the feed passage 762B.

A as shown in FIG. 2 and FIG. 3, the color ink is supplied to the nozzle arrays 121-124 of the head unit 200 from the cartridges 303-306 via the first connection passages 621-624, the valve portion 961, the sub-tanks 911-914 and the second connection passages 631-634, respectively. Because the pumps 901-904 are not activated during the printing, the white ink does not flow in the circulation passages 771A, 772A, 771B and 772B.

As shown in the enlarged view W2 in FIG. 2, the meniscus is created on the nozzle face 111 (i.e., the ink 97 makes a recess in the nozzle 113) due to the surface tension when the printing is completed. The meniscus holds the ink 97 on the nozzle face 111.

The circulating operation will be described. The pumps 901-904 are activated during a no printing time (i.e., while the ink 97 is not being injected from the nozzle 113) under the control of the CPU to perform the circulating operation. During the circulating operation, as indicated by the arrow 90 in FIG. 2 and the arrow 90 in FIG. 3, the ink 97 is circulated through the feed passages 761A, 762A, 761B and 762B and the circulation passages 771A, 772A, 771B and 772B. This generates the stirring of the white ink, which is the high precipitationability fluid.

The printer 1 of this embodiment has the above-described configuration. In this embodiment, the second mount portions 821 and 822 and the sub-tanks 91 are located in the second region 212. Thus, the head difference of the ink 97 based on the position of the sub-tanks 91 and the position of the nozzle face 111 becomes substantially equal to the head difference of the ink 97 based on the position of the second mount portions 821, 822 and the position of the nozzle face 111. Accordingly, the meniscus properly holds the ink 97 on the nozzle face 111, and insufficient injection of the ink 97 becomes difficult to occur. As such, it is possible to reduce the possibility of printing quality deterioration. The sub-tanks 91 incline diagonally relative to the horizontal plane, and the upper ends of the sub-tanks 91 are situated slightly above the second region 212, but the head of the ink 97 in the sub-tanks 91 is in the second region 212. In each of the cartridges 301 and 302, the shaft 43 shown in FIG. 5 is biased in the rear direction by the resilient member 45, and winds up the liquid bag 13. Thus, the pressure for expelling the ink 97 from the liquid bag 13 is greater than the pressure when there are no resilient member 45 and the shaft 43. As such, the head of the ink 97 within the liquid container 31 in the cartridge 301, 302 is above the second mount portion 821, 822, but is in the second region 212.

As shown in FIG. 2 and FIG. 3, the non-reservoir passages 72A and 72B do not have the sub-tanks 91. In other words, some of the fluid passages extending to the head portion 110 from the respective mount portions 80 are only equipped with the sub-tanks 91. Thus, it is possible to reduce the number of parts, as compared to a configuration that has the sub-tanks 91 for all the fluid passages extending to the head portion 110 from the respective mount portions 80.

The cartridges 301 and 302, which contain the white ink or the high precipitationability liquid, are mounted in the second mount portions 821 and 822, which connect to the non-reservoir passages 72A and 72B. Because the non-reservoir passages 72A and 72B have no sub-tanks 91, it is possible to prevent the white ink component, which has the high precipitationability, from remaining in the sub-tanks 91, and prevent the concentration of the white ink component injected from the nozzle 113 from decreasing. Accordingly, it is possible to reduce the possibility of printing quality deterioration.

Because the circulation passages 771A, 772A, 771B and 772B are provided, and the white ink is stirred by the pumps 901-904, the white ink component having the high precipitationability becomes difficult to precipitate in the non-reservoir passages 72A and 72B. It is, therefore, possible to reduce the possibility that the white ink component injected from the nozzle 113 would have a reduced concentration, and reduce the possibility of printing quality deterioration.

During the printing, the movement of the ink 97 injected from the nozzle 113 serves as a pumping force that pulls the ink 97 toward the nozzle face 111, and the ink 97 is supplied to the nozzle face 111. If the pumps 901-904 are activated during the printing, the pressure exerted by the pumps 901-904 applies to the ink 97, and the ink 97 may not be injected appropriately. In this embodiment, the pumps 901-904 are activated while the printing is not being carried out, i.e., while the ink 97 is not being injected from the nozzle 113. Thus, the white ink, i.e., the high precipitationability liquid, is circulated from the non-reservoir passages 72A and 72B. Accordingly, the pumps 901-904 are not activated during the printing, and the ink 97 is injected appropriately. Because the pumps 901-904 are activated during the no printing time to stir the white ink, the white ink component is difficult to precipitate in the non-reservoir passages 72A and 72B. Thus, it is possible to reduce the possibility that the white ink component injected from the nozzle 113 would have a reduced concentration, and to reduce the possibility that the printing quality would be deteriorated.

The diameter of each of the circulation passages 771A, 772A, 771B and 772B is smaller than the diameter of each of the non-reservoir passages 72A and 72B. Therefore, it is possible to reduce the possibility that the circulation passages 771A, 772A, 771B and 772B would interfere with other fluid passages, as compared to a configuration that the diameter of each of the circulation passages 771A, 772A, 771B and 772B is greater than the diameter of each of the non-reservoir passages 72A and 72B. The circulation passages 771A, 772A, 771B and 772B are equipped with the pumps 901, 902, 903 and 904, respectively, it is possible to circulate the white ink even if the diameter of each of the circulation passages 771A, 772A, 771B and 772B is smaller than the diameter of each of the non-reservoir passages 72A and 72B. Because the non-reservoir passages 72A and 72B have appropriate diameters, it is possible to properly feed the white ink to the nozzle face 111. Thus, it is possible to reduce the possibility of the deterioration in the printing quality. As compared to a configuration that the diameter of each of the circulation passages 771A, 772A, 771B and 772B is greater than the diameter of each of the non-reservoir passages 72A and 72B, the circulation passages 771A, 772A, 771B and 772B are easy to bend. Thus, the freedom with regard to the piping increases.

As shown in FIG. 11, the non-reservoir passages 72A and 72B (see FIG. 2 and FIG. 3) bend in a direction that crosses the rear direction heading to the sub-tanks 91 from the second mount portions 821 and 822 (see FIG. 2, FIG. 8 and FIG. 3) at the first branch portions 753A and 753B, respectively. Thus, it is possible to place the sub-tanks 91 closer to the second mount portions 821 and 822, as compared to a configuration having no first branch portions 753A and 753B. As such, the printer 1 can be downsized.

As shown in FIG. 2, FIG. 3 and FIG. 7 to FIG. 10, the second branch portions 791A, 792A, 791B and 792B and the bend portions 781A, 782A, 781B and 782B are located closer to the head portion 110 than the first branch portions 753A and 753B (i.e., situated on the downstream side) in the non-reservoir passages 72A and 72B, and bend at positions between the mount portions 80 and the sub-tanks 91 in the horizontal direction. Thus, as compared to a configuration that the first branch portions 753A and 753B are only provided, the non-reservoir passages 72A and 72B have more bend portions. Accordingly, it is possible to bend the non-reservoir passages 72A and 72B by means of the second branch portions 791A, 792A, 791B and 792B and the bend portions 781A, 782A, 781B and 782B, and avoid the reservoir passages 711-714 extending from the mount portions 80 when locating the non-reservoir passages 72A and 72B. Therefore, it is possible to reduce the possibility of interference between the reservoir passages 711-714 and the non-reservoir passages 72A and 72B. As such, it is possible to reduce the possibility that the reservoir passages 711-714 would interfere with the non-reservoir passages 72A and 72B, the fluid passages would bend, feeding the ink 97 to the nozzle face 111 would become difficult, and the printing quality would drop.

In the non-reservoir passages 72A and 72B, fluid passages from the second mount portions 821 and 822 to the second branch portions 791A, 792A, 791B and 792B are present outside the area of connections of the circulation passages 771A, 772A, 771B and 772B. Thus, stirring of the high precipitationability liquid is difficult to occur between the second mount portions 821 and 822 and the second branch portions 791A, 792A, 791B and 792B. In this embodiment, the second branch portions 791A, 792A, 791B and 792B are located closer to the second mount portions 821 and 822 than the head unit 100. As a result, it is possible to shorten the lengths of the fluid passages from the second mount portions 821 and 822 to the second branch portions 791A, 792A, 791B and 792B, as compared to a configuration that the second branch portions 791A, 792A, 791B and 792B are located closer to the head unit 100 than the second mount portions 821 and 822. In this embodiment, the second branch portions 791A, 792A, 791B and 792B are located between the mount portions 80 and the sub-tanks 91 in the horizontal direction. As a result, it is possible to shorten the lengths of the fluid passages from the second mount portions 821 and 822 to the second branch portions 791A, 792A, 791B and 792B, as compared to a configuration that the second branch portions 791A, 792A, 791B and 792B are provided at positions further to the rear direction (a direction from the mount portions 80 toward the sub-tanks 91) than the sub-tanks 91. Therefore, it is possible to expand the area for stirring the high precipitationability liquid in the non-reservoir passages 72A and 72B. As such, it is possible to reduce the possibility that the high precipitationability liquid would not be stirred, the component of the high precipitationability liquid injected from the nozzle 113 would have a reduced concentration, and the printing quality would drop.

The filter portions 681A, 682A, 681B and 682B have higher passage resistances than the circulation passages 771A, 772A, 771B and 772B, respectively. Thus, the white ink that is present downstream of the filter portions 681A, 682A, 681B and 682B tends to flow in the circulation passages 771A, 772A, 771B and 772B rather than in the filter portions 681A, 682A, 681B and 682B. Accordingly, the white ink tends to flow in the circulation passages 771A, 772A, 771B and 772B upon stirring of the white ink with the pumps 901-904, and the white ink is difficult to flow back toward the second mount portions 821 and 822, as compared to a configuration having no filter portions 681A, 682A, 681B and 682B. Thus, it is possible to reduce the possibility that the white ink would flow back to the second mount portions 821 and 822, and the ink 97 would not be injected properly from the nozzle 113. This reduces the possibility of printing quality deterioration.

The second mount portions 821 and 822 and the sub-tanks 91 are provided in the second region 212. If the second mount portions 821 and 822 are located above the first mount portions 811-814, then the sub-tanks 91 would be situated above the first mount portions 811-814. Thus, pumps are required to pull up the ink 97 to the sub-tanks 91 from the first mount portions 811-814. In this embodiment, the second mount portions 821 and 822 are located below the first mount portions 811-814, and therefore the sub-tanks 91 are situated below the first mount portions 811-814. Thus, the gravity can be used to feed the ink 97 to the sub-tanks 91 from the first mount portions 811-814. Accordingly, it is not necessary to provide pumps to feed the ink 97 to the sub-tanks 91, and it is possible to reduce the number of parts.

The second mount portions 821 and 822 are located below the first mount portions 811-814. If the circulation passages 771A, 772A, 771B and 772B are located above the sub-tanks 91, then the first connection passages 621-624 extending to the sub-tanks 91 from the first mount portions 811-814 tend to interfere with the circulation passages 771A, 772A, 771B and 772B. In this embodiment, certain part of the circulation passages 771A, 772A, 771B and 772B are located below the sub-tanks 91. Thus, the first connection passages 621-624 extending to the sub-tanks 91 from the first mount portions 811-814 are difficult to interfere with the circulation passages 771A, 772A, 771B and 772B. Otherwise the reservoir passages 711-714 would interfere with the non-reservoir passages 72A and 72B and the fluid passages would bend such that feeding the ink 97 to the nozzle face 111 would become difficult. As such, it is possible to reduce the possibility of the printing quality deterioration.

The present disclosure is not limited to the above-described embodiment, and various changes and modifications may be made to the above-described embodiment. For example, although the high precipitationability liquid is the white in the above-described embodiment, the present invention is not limited in this regard. The high precipitationability liquid may be another liquid as long as the liquid includes a component that has higher precipitationability than the liquid contained in the cartridges 303-304 to be mounted in the first mount portions 811-814. The liquid to be injected from the nozzle face 111 is not limited to the ink 97. For example, the liquid to be injected from the nozzle face 111 may be a discharge printing agent for decoloring a dyed fabric. One of the non-reservoir passages 72A and 72B may only be provided.

Although a certain part of each circulation passage 771A, 772A, 771B, 772B is located below the associated sub-tank 91, that part of the circulation passage may be located at a position other than below the associated sub-tank. For example, a certain part of the circulation passage 771A, 772A, 771B, 772B may be located on the right or left of the sub-tank 91. Although the second mount portions 821 and 822 are located below the first mount portions 811-814, the present disclosure is not limited in this regard. For example, the second mount portions 821 and 822 may be located above the first mount portions 811-814. In this configuration, the first mount portions 811-814 are located in the first region 211 (see FIG. 2) below the second region 212. The second branch portions 791A, 792A, 791B and 792B are provided between the mount portions 80 and the sub-tanks 91 in the horizontal direction. It should be noted, however, that the second branch portions 791A, 792A, 791B and 792B may be provided at positions other than between the mount portions 80 and the sub-tanks 91 in the horizontal direction. For example, the second branch portions 791A, 792A, 791B and 792B may be provided closer to the head unit 100 than the second mount portions 821 and 822.

The second branch portions 791A, 792A, 791B and 792B and the bend portions 781A, 782A, 781B and 782B, at which the non-reservoir passages 72A and 72B bend, are provided on the downstream side (i.e., closer to the head portion 110 than the first branch portions 753A and 753B) in the above-described embodiment, but the present disclosure is not limited in this regard. It is only necessary to provide at least one bend portion on the non-reservoir passage 72A, 72B, which is situated on the downstream side (closer to the head portion 110 than the first branch portions 753A, 753B). One bend portion or three or more bend portions may be provided on the non-reservoir passage 72A, 72B. In such configuration, it is also possible to reduce the possibility that the reservoir passages 711-714 would interfere with the non-reservoir passages 72A and 72B, as compared to a configuration having the first branch portions 753A and 753B only, because the non-reservoir passages 72A and 72B have more bend portions. Thus, it is possible to reduce the possibility of the printing quality deterioration. There may be no branch at each of the first branch portions 753A and 753B, and there may only be provided the bend portion that bends in a direction crossing the rear direction that is a direction from the second mount portions 821 and 822 to the sub-tanks 91. Although the second branch portions 791A, 792A, 791B and 792B and the bend portions 781A, 782A, 781B and 782B are situated between the mount portions 80 and the sub-tanks 91 in the horizontal direction, the second branch portions 791A, 792A, 791B and 792B and the bend portions 781A, 782A, 781B and 782B may be situated at positions other than between the mount portions 80 and the sub-tanks 91. There may be no bend portions at the first branch portions 753A and 753B, and alternatively there may be bend portions at positions other than the first branch portions 753A and 753B. The first branch portions 753A and 753B having a bending shape may be omitted.

The pumps 901-904 may be activated during the print time, i.e., while the ink 97 being injected from the nozzle 113, to circulate the high precipitationability liquid from the non-reservoir passages 72A and 72B. Electromagnetic valves may be provided on the feed passages 761A, 762A, 761B and 762B immediately before connecting to the nozzle face 111, and the pumps 901-904 may be activated with the electromagnetic valves being closed, to circulate the high precipitationability liquid. The circulation passages 771A, 772A, 771B and 772B and the pumps 901-904 may be omitted. In this configuration, the bend portions that bend toward the feed passages 761A, 762A, 761A and 762B may only be provided at the second branch portions 791A, 792A, 791B and 792B. The second branch portions 791A, 792A, 791B and 792B may be omitted.

The cartridges 301 and 302, which carry the high precipitationability liquid therein, are located at the second mount portions 821 and 822 in the above-described embodiment. It should be noted, however, that the cartridge 3 for carrying the liquid that contains a component having the same precipitationability as (or a smaller precipitationability than) the ink 97, which is carried in the cartridges 303-306 mounted in the first mount portions 811-814, may be located at the second mount portions 821 and 822. Although the cartridge 3 has the shaft 43 and the resilient member 45 in the above-described embodiment (see FIG. 5), the cartridge 3 may have no shaft 43 and no resilient member 45. The filter portions 681A, 682A, 681B and 682B may be omitted.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A print device comprising:

a head having a nozzle face, the nozzle face having a nozzle for injecting liquid;

a plurality of mount portions arranged in an up-down direction, each of the plurality of the mount portions being configured to mount each of a plurality of containers, each of the plurality of the containers being configured to contain the liquid;

the plurality of the mount portions including a first mount portion and a second mount portion, the first mount portion being located in a first region, the first region being a region in which a distance from the nozzle face in the up-down direction being out of a predetermined range, the second mount portion being located in a second region, the second region being a region in which a distance from the nozzle face in the up-down direction being in the predetermined range; and the print device also comprising a reservoir passage and a non-reservoir passage, the reservoir passage being configured to connect the first mount portion to the head and having a reservoir located in the second region, the reservoir being configured to reserve the liquid, the non-reservoir passage being configured to connect the second mount portion to the head and having no reservoir.

2. The print device according to claim 1, wherein the second mount portion is configured to mount a high precipitationability liquid container containing high precipitationability liquid, the high precipitationability liquid including a component having higher precipitationability than the liquid contained in the container mounted at the first mount portion.

3. The print device according to claim 2, further comprising:

a circulation passage connected to the non-reservoir passage, wherein the high precipitationability liquid from the non-reservoir passage circulates in the circulation passage; and a pump provided on the circulation passage and configured to be activated to circulate the high precipitationability liquid in the non-reservoir passage.

4. The print device according to claim 3, wherein the high precipitationability liquid from the non-reservoir passage is caused to circulate upon activation of the pump during a no printing time.

5. The print device according to claim 1, wherein the reservoir is located to face the second mount portion in a horizontal direction, wherein the non-reservoir passage has a first bend portion that bends in a second direction between the second mount portion and the reservoir located on the reservoir passage, and wherein the second direction crosses a first direction extending to the reservoir from the second mount portion.

6. The print device according to claim 5, further comprising at least one second bend portion provided on the non-reservoir passage at a position or positions closer to the head than the first bend portion, wherein the at least one second bend portion is located and bends between the mount portion and the reservoir in the horizontal direction.

7. The print device according to claim 3, further comprising a branch portion on the non-reservoir passage at a position closer to the mount portion than the head, wherein the non-reservoir passage and the circulation passage branch at the branch portion.

8. The print device according to claim 7, further comprising a regulator portion provided on a fluid passage between the mount portion and the branch portion, wherein passage resistance of the regulator portion is higher than passage resistance of the circulation passage.

9. The print device according to claim 3, wherein the second mount portion is located below the first mount portion.

10. The print device according to claim 9, wherein a part of the circulation passage is located below the reservoir.

11. The print device according to claim 2, wherein the high precipitationability liquid is a white ink.

* * * * *